US012523208B2

(12) United States Patent
Chen

(10) Patent No.: US 12,523,208 B2
(45) Date of Patent: Jan. 13, 2026

(54) MULTIPURPOSE INFLATION PUMP

(71) Applicant: JINGYAN MECHANICAL & ELECTRICAL TOOLS CO., LTD, JINHUA, Jinhua (CN)

(72) Inventor: Huabin Chen, Jinhua (CN)

(73) Assignee: JINGYAN MECHANICAL & ELECTRICAL TOOLS CO., LTD, JINHUA, Jinhua (CN)

( * ) Notice: Subject to any disclaimer, the term of this patent is extended or adjusted under 35 U.S.C. 154(b) by 59 days.

(21) Appl. No.: 18/202,854

(22) Filed: May 26, 2023

(65) Prior Publication Data

US 2023/0323870 A1 Oct. 12, 2023

Related U.S. Application Data

(63) Continuation of application No. PCT/CN2022/079470, filed on Mar. 7, 2022.

(30) Foreign Application Priority Data

Jul. 13, 2021 (CN) ..... 202121584364.0

(51) Int. Cl.
*F04B 35/04* (2006.01)
*F04B 37/10* (2006.01)
*F04B 53/08* (2006.01)

(52) U.S. Cl.
CPC ..... *F04B 35/04* (2013.01); *F04B 37/10* (2013.01); *F04B 53/08* (2013.01)

(58) Field of Classification Search
USPC ..... 417/415
See application file for complete search history.

(56) References Cited

U.S. PATENT DOCUMENTS 4,080,103 A * 3/1978 Bird ..... F04B 39/066 96/400
4,389,166 A * 6/1983 Harvey ..... F04B 35/04 D15/7

(Continued)

FOREIGN PATENT DOCUMENTS

CN 201258841 Y * 6/2009
CN 101846054 A * 9/2010

(Continued)

OTHER PUBLICATIONS

Machine Translation of CN-201258841 Shao (Obtained from USPTO Search) (Year: 2025).*

(Continued)

*Primary Examiner* — Dominick L Plakkoottam
*Assistant Examiner* — Geoffrey S Lee

(57) ABSTRACT

A multipurpose inflation pump is provided. The multipurpose inflation pump includes a housing provided with a device cavity and a storage cavity which is configured to place an accessory. The device cavity is provided with a first inflation unit and a second inflation unit, and an inflation pressure of the first inflation unit is lower than an inflation pressure of the second inflation unit. The multipurpose inflation pump can not only rapidly inflate and deflate an inflatable bed, an inflatable boat, etc., but also provide higher inflation pressure to inflate an automobile tire, thus combining multiple uses in a single machine and helping consumers save cost.

7 Claims, 8 Drawing Sheets

(56) References Cited

U.S. PATENT DOCUMENTS 4,614,479 A * 9/1986 Liu ..... F04B 49/022 307/118
4,636,230 A * 1/1987 Fan ..... B01D 46/2403 15/345
4,656,687 A * 4/1987 Wei ..... A47L 5/24 15/324
4,789,310 A * 12/1988 Hung ..... F21V 33/0088 417/313
5,775,591 A * 7/1998 Fauci ..... B05B 9/0816 239/375
6,094,773 A * 8/2000 Krentz ..... A47L 7/00 417/234
6,146,108 A * 11/2000 Mullendore ..... F04D 13/068 417/234
6,623,249 B1 * 9/2003 Rogers ..... F04B 41/06 417/428
6,655,928 B2 * 12/2003 Chou ..... F04B 39/125 417/415
6,779,227 B2 * 8/2004 Lee ..... A47L 9/2836 15/328
7,152,272 B2 * 12/2006 Rukavina ..... A47L 9/1666 15/313
7,494,327 B2 * 2/2009 Etter ..... F04B 41/02 417/234
8,079,824 B2 * 12/2011 Chou ..... F04B 35/06 417/16
8,393,873 B2 * 3/2013 Hill ..... F04B 49/065 417/63
9,759,207 B2 * 9/2017 Chou ..... F04B 39/127
9,879,665 B2 * 1/2018 Chou ..... F04B 53/16
9,879,682 B1 * 1/2018 Beliveau ..... A47C 27/082
10,077,765 B2 * 9/2018 Chou ..... F04B 35/06
10,138,878 B2 * 11/2018 Chou ..... F04B 39/125
10,731,637 B2 * 8/2020 Walmsley ..... F04B 35/06
D952,001 S * 5/2022 Schildger ..... D15/7
D956,826 S * 7/2022 Costle ..... D15/7
D959,498 S * 8/2022 Schildger ..... D15/7
11,686,299 B2 * 6/2023 Huang ..... F04B 41/06 60/452
2004/0049842 A1 * 3/2004 Prehodka ..... A61H 33/028 4/559
2005/0031458 A1 * 2/2005 Brashears ..... B25H 3/006 417/313
2008/0213089 A1 * 9/2008 McCurry ..... F04B 41/06 454/186
2008/0240943 A1 * 10/2008 Wang ..... F04B 35/01 417/361
2015/0285236 A1 * 10/2015 Chou ..... F04B 39/121 417/415
2015/0337825 A1 * 11/2015 Chou ..... F04B 37/18 417/415
2017/0037844 A1 * 2/2017 Takeuchi ..... F04B 49/10
2018/0211572 A1 * 7/2018 Leuthe ..... G09F 3/00
2021/0108629 A1 * 4/2021 Wood ..... F04B 27/0538
2023/0323870 A1 * 10/2023 Chen ..... F04B 37/10

FOREIGN PATENT DOCUMENTS

CN 110273827 A * 9/2019 ..... F04B 35/04
CN 111197570 A * 5/2020
CN 111255661 A 6/2020
CN 212272509 U 1/2021
CN 212744241 U 3/2021
CN 215370147 U 12/2021
DE 102019215023 A1 4/2021
EP 3567249 A2 11/2019

OTHER PUBLICATIONS

Machine Translation of CN-110273827 Huang (Obtained from USPTO Search) (Year: 2024).*
Machine Translation of CN-111197570 Lu (Obtained from USPTO Search) (Year: 2024).*
Machine Translation of CN-101846054 Medich (Obtained from USPTO Search) (Year: 2024).*
International Search Report of PCT/CN2022/079470.
European search report of EP22839979.6 dated Sep. 2, 2024.

* cited by examiner

MULTIPURPOSE INFLATION PUMP

CROSS-REFERENCE TO RELATED APPLICATIONS

This application is a continuation of international patent application No. PCT/CN2022/079470, filed on Mar. 7, 2022, which itself claims priority to Chinese patent application No. 202121584364.0, filed on Jul. 13, 2021, titled "MULTIPURPOSE INFLATION PUMP", which is hereby incorporated by reference.

TECHNICAL FIELD

The present disclosure relates to the field of an inflation pump, and in particular, to a multipurpose inflation pump.

BACKGROUND

At present, a conventional electric pump may rapidly inflate or deflate an inflatable bed or an inflatable boat, and is increasingly popular among consumers because of its portable nature. However, this conventional air pump cannot inflate an automobile tire, because the automobile tire inflates to a higher air pressure, so that only a special inflation pump can be used. Consumers often drive automobiles and would need two inflation pumps: one electric air pump for inflating automobile tires, and the other electric air pump for inflating or deflating other low-pressure items, which not only causes an economic burden, but also increases the number of items carried, thereby affecting portability.

SUMMARY

A multipurpose inflation pump can not only rapidly inflate or deflate an inflatable bed or an inflatable boat, but also provide higher air pressure to inflate the automobile tire, have multi-purposes, and help the consumers save money.

A purpose of the present disclosure may be achieved via the following technical solution: a multipurpose inflation pump includes a housing, the housing is provided with a device cavity and a storage cavity which is configured to place an accessory, the device cavity is provided with a first inflation unit and a second inflation unit, and an inflation pressure of the first inflation unit is lower than an inflation pressure of the second inflation unit.

In the above solution, the first inflation unit may inflate or deflate the inflatable bed or the inflatable boat which needs less high inflation pressure, and the second inflation unit may inflate the automobile tire which needs higher inflation pressure. The multipurpose inflation pump may have multi-purposes and help the consumers save cost.

In some embodiments, the first inflation unit includes an inflation conduit, an inlet of the inflation conduit is connected to a first pressure air pump and a blower, and an outlet of the first pressure air pump and an outlet of the blower are sealed to and connected to the inlet of the inflation conduit, respectively. The blower and the first pressure air pump may operate in cooperation, and the blower may provide a large flow of air with less pressure to rapidly inflate in an initial inflation, saving a preliminary blowing time. When inflating for a period of time, the blower may stop operation, and the first pressure air pump may be switched to operate to continue to provide airflow with a certain pressure, ensuring that an inflated object is filled up. When the inflatable bed or the inflatable boat needs to be deflated, an inlet of the blower is put to an outlet of the inflatable bed or the inflatable boat, and the blower may accelerate deflation of the inflatable bed or the inflatable boat.

In some embodiments, the blower includes a shell, a first motor is disposed in the shell, an output shaft of the first motor is fixedly connected to an air blade, and a first one-way outlet valve is disposed in the shell proximal to the outlet of the blower and configured to flow out one-way air towards the inflation conduit; and the first pressure air pump includes a first piston cylinder, an outlet of which is provided with a second one-way outlet valve, the second one-way outlet valve is configured to flow out one-way air towards the inflation conduit, a first piston is disposed in the first piston cylinder and cooperated with the second one-way outlet valve, the first piston is provided with a first one-way inlet valve, an end of the first piston away from the second one-way outlet valve is fixedly connected to a first connecting rod, the first connecting rod is rotatably connected to an eccentric wheel, which is driven by a first large gear engaged with a first pinion gear, the first pinion gear is connected to an output shaft of a second motor, and an end of the second motor is provided with a first cooling fan. The first cooling fan may dissipate heat for the second motor better.

In some embodiments, the housing is further provided with an accessed hole configured to allow both an outlet of the inflation conduit and an inlet of the blower to extend out of the housing.

In some embodiments, the device cavity and the storage cavity are separated from each other, and a partition plate between the device cavity and the storage cavity is provided with a plurality of cooling holes. The cooling holes may not only accelerate heat dissipation of the device cavity, but also provide air intake to the first pressure air pump and a second pressure air pump in the device cavity.

In some embodiments, the second inflation unit includes a second pressure air pump, the second pressure air pump includes a third motor, an output shaft of the third motor is connected to a second pinion gear, an end of the third motor is provided with a second cooling fan, the second pinion gear is engaged with a second large gear, a gear plate of the second large gear is rotatably connected to a second connecting rod, and a connecting portion between the second connecting rod and the second large gear is proximal to an outer side of the gear plate of the second large gear; the second pressure air pump further includes a second piston cylinder, a second piston is disposed in the second piston cylinder, the second piston is fixedly connected to an end of the second connecting rod away from the second large gear, a surface of the second piston away from the second connecting rod is provided with a second one-way inlet valve arranged in the second piston cylinder, the second piston cylinder is provided with an outlet nozzle, the outlet nozzle is disposed on a sidewall of the second piston cylinder and in communication with the second piston cylinder, and the outlet nozzle is located between the second one-way inlet valve and the second piston and proximal to the second one-way inlet valve; and the outlet nozzle of the second pressure air pump is further connected to an air pipe which penetrates through the device cavity and into the storage cavity.

In some embodiments, a plurality of sheets are disposed in the storage cavity, the plurality of sheets are further provided with mounting grooves with different sizes, a rapid conversion joint is placed in the mounting grooves, and the housing is further provided with a cover to enter into the storage cavity. Rapid conversion joints with different size may be placed in the mounting grooves.

In some embodiments, the inflation conduit is further provided with a mounting hole for a pressure sensor proximal to the outlet thereof, a first pressure sensor is disposed in the mounting hole for the pressure sensor, and a second pressure sensor is disposed in the outlet nozzle of the second pressure air pump.

In some embodiments, the housing is further provided with a controller, the controller includes a circuit board, and all of motors and pressure sensors of the first inflation unit and the second inflation unit are electrically connected to the circuit board. Both of the first inflation unit and the second inflation unit are controlled by the controller.

In some embodiments, an outer surface of the housing is provided with a storage groove which is internal concave, and the storage groove is configured to place an extended pipe connected to the outlet of the inflation conduit.

Compared with the related art, the present disclosure may have the following advantages: the multipurpose inflation pump can not only rapidly inflate or deflate the inflatable bed or the inflatable boat, but also provide higher air pressure to inflate the automobile tire, have multi-purposes, and help the consumers save cost.

In the FIGURES, 1 represents a housing, 2 represents a device cavity, 3 represents a storage cavity, 4 represents an inflation conduit, 5 represents a first pressure air pump, 6 represents a blower, 7 represents a shell, 8 represents a first motor, 9 represents an air blade, 10 represents a first one-way outlet valve, 11 represents a first piston cylinder, 12 represents a second one-way outlet valve, 13 represents a first piston, 14 represents a first one-way inlet valve, 15 represents a first connecting rod, 16 represents an eccentric wheel, 17 represents a first pinion gear, 18 represents a first large gear, 19 represents a second motor, 20 represents a first cooling fan, 21 represents an accessed access hole, 22 represents a cooling hole, 23 represents a second pressure air pump, 24 represents an air pipe, 25 represents a sheet, 26 represents a mounting groove, 26*a* represents a rapid conversion joint; 27 represents a cover, 28 represents a mounting hole for a pressure sensor, 29 represents a controller, 30 represents a circuit board, 31 represents a storage groove, 32 represents an extended pipe, 33 represents a second piston cylinder, 34 represents a second piston, 35 represents a second one-way inlet valve, 36 represents a second connecting rod, 37 represents a second pinion gear, 38 represents a second large gear, 38*a* represents a gear plate of the second large gear, 39 represents a third motor, 40 represents a second cooling fan, 41 represents an outlet nozzle, and 42 represents a partition plate.

DETAILED DESCRIPTION

The present disclosure is further described hereinafter in combination with the embodiments represented in the accompanying drawings.

Figure 1:
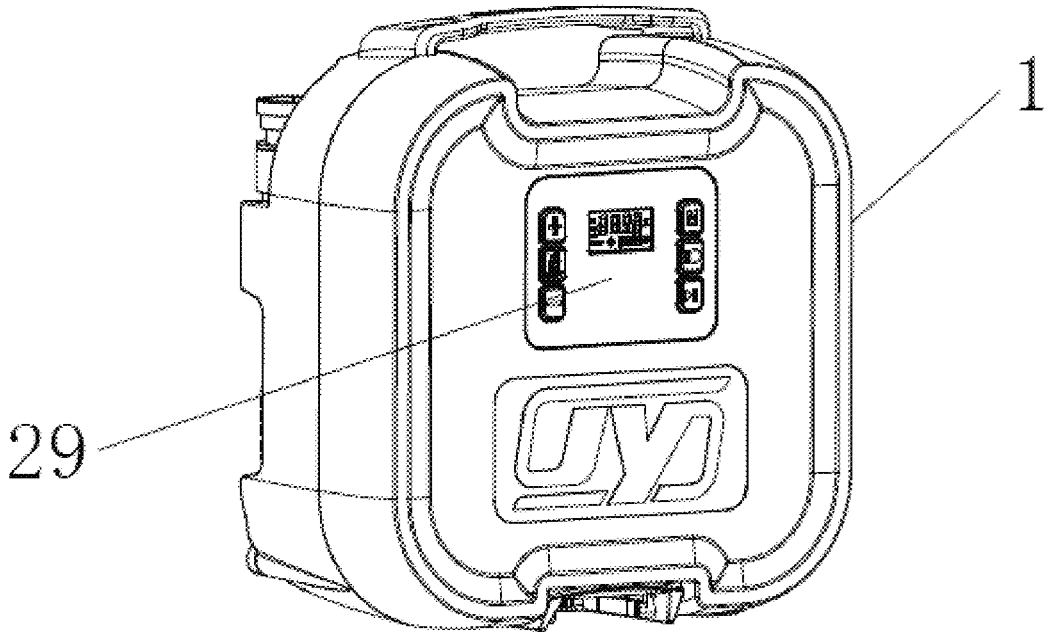
FIG. 1 is a schematic diagram of an overall structure of a multipurpose inflation pump in an embodiment of the present disclosure.
Figure 2:
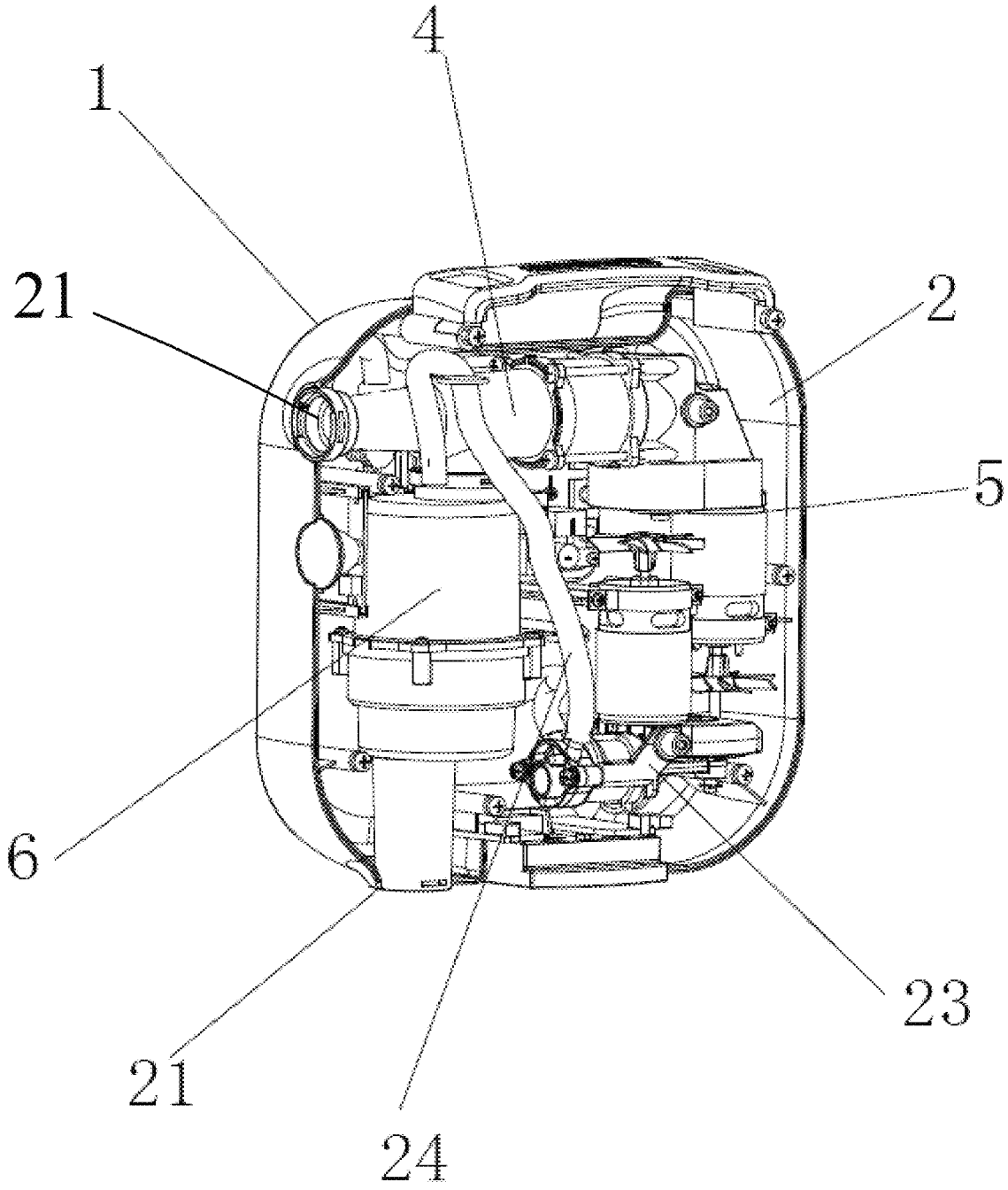
FIG. 2 is a schematic diagram of a device cavity in an embodiment of the present disclosure.
Figure 3:
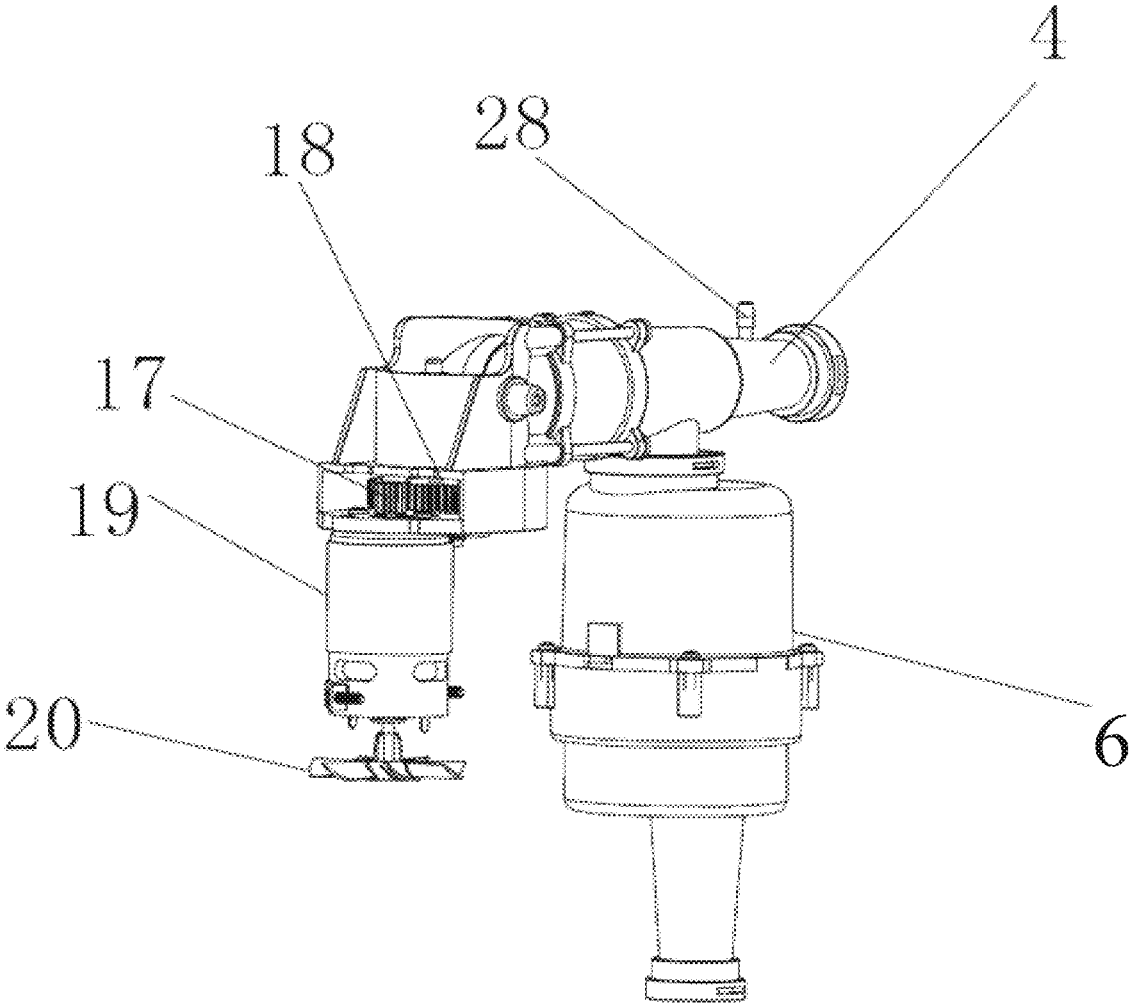
FIG. 3 is a schematic diagram of a first inflation unit in an embodiment of the present disclosure.
Figure 4:
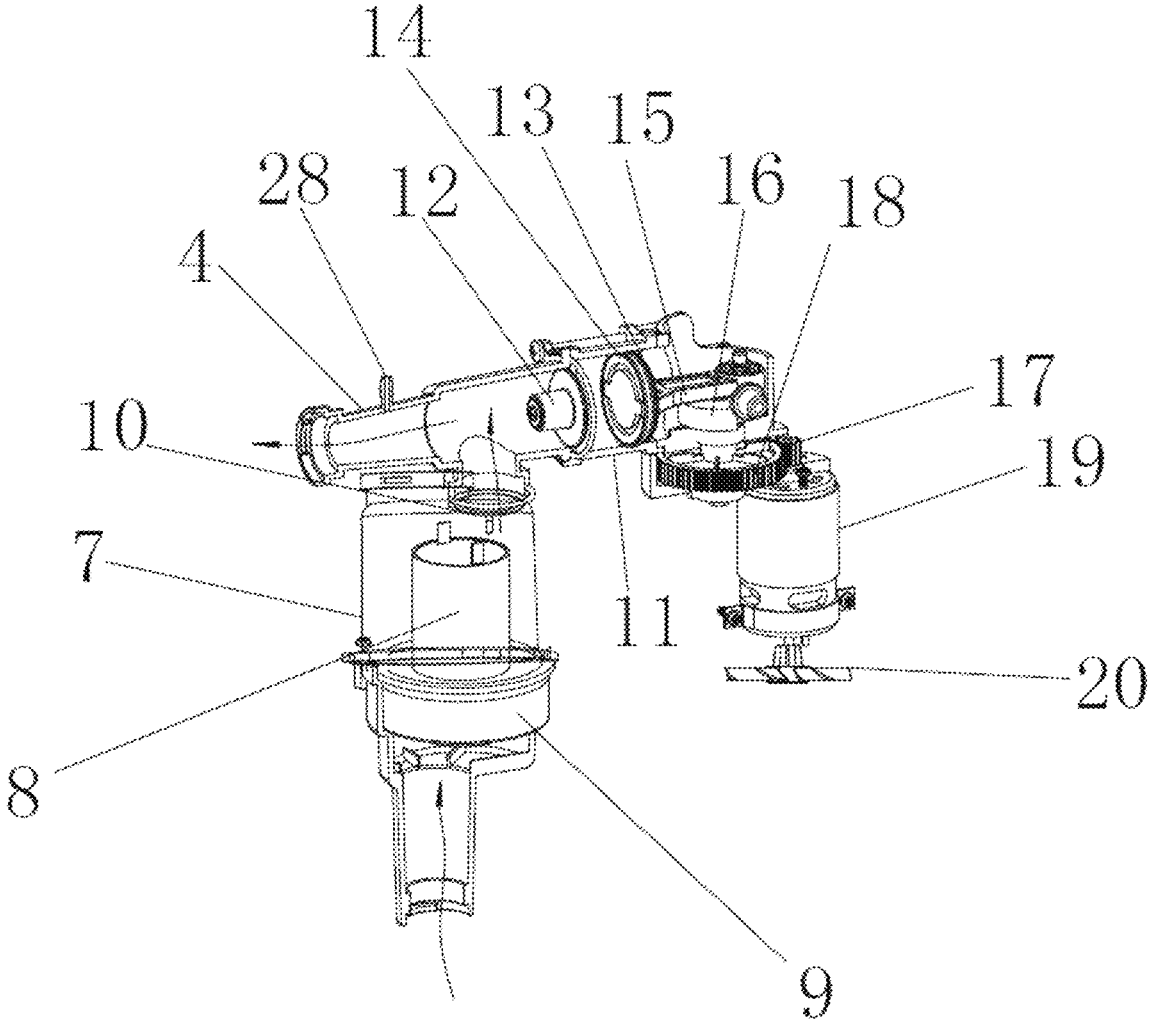
FIG. 4 is a schematic diagram of a section of a first inflation unit in an embodiment of the present disclosure.
Figure 5:
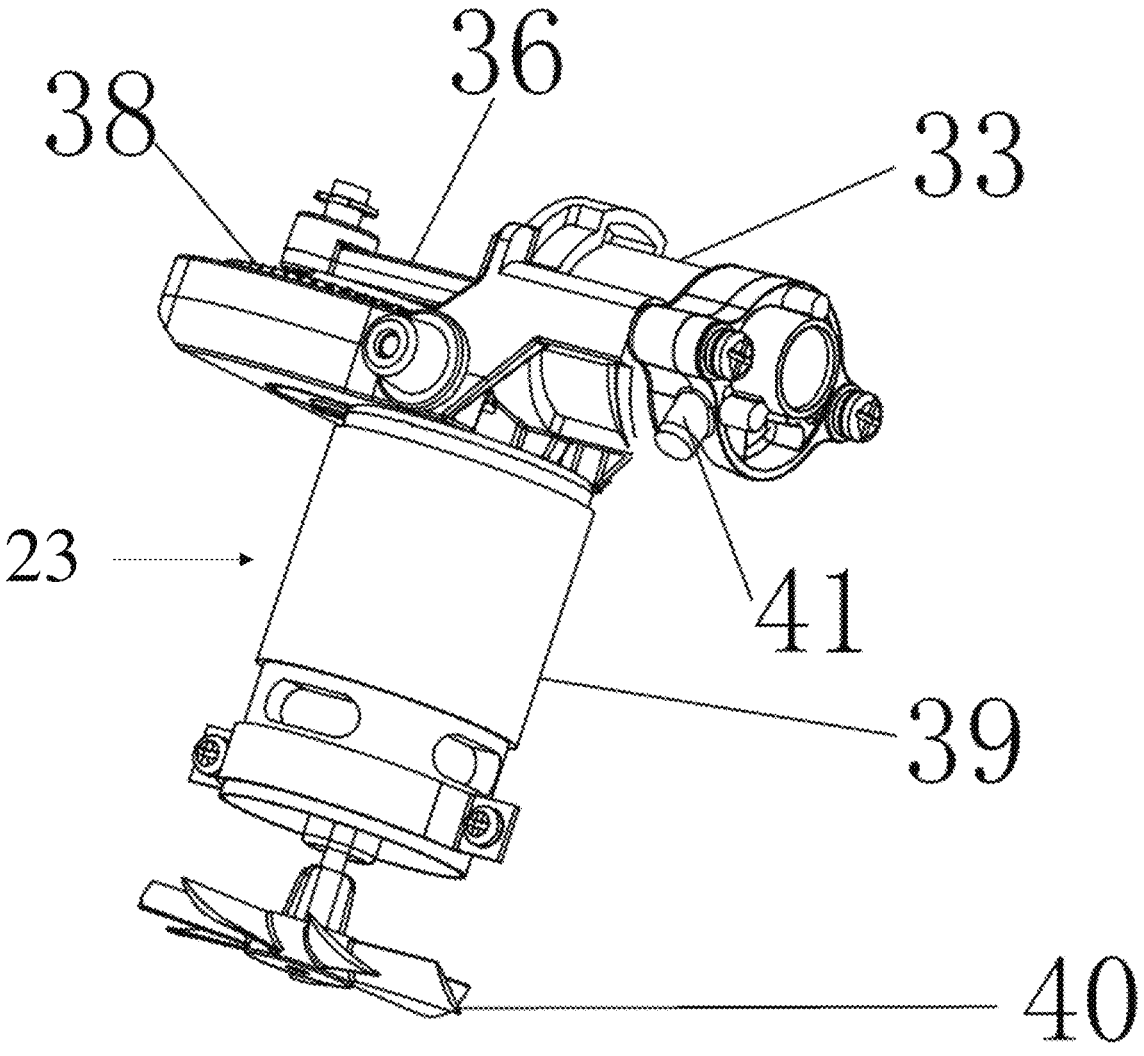
FIG. 5 is a schematic diagram of a second pressure air pump in an embodiment of the present disclosure.
Figure 6:
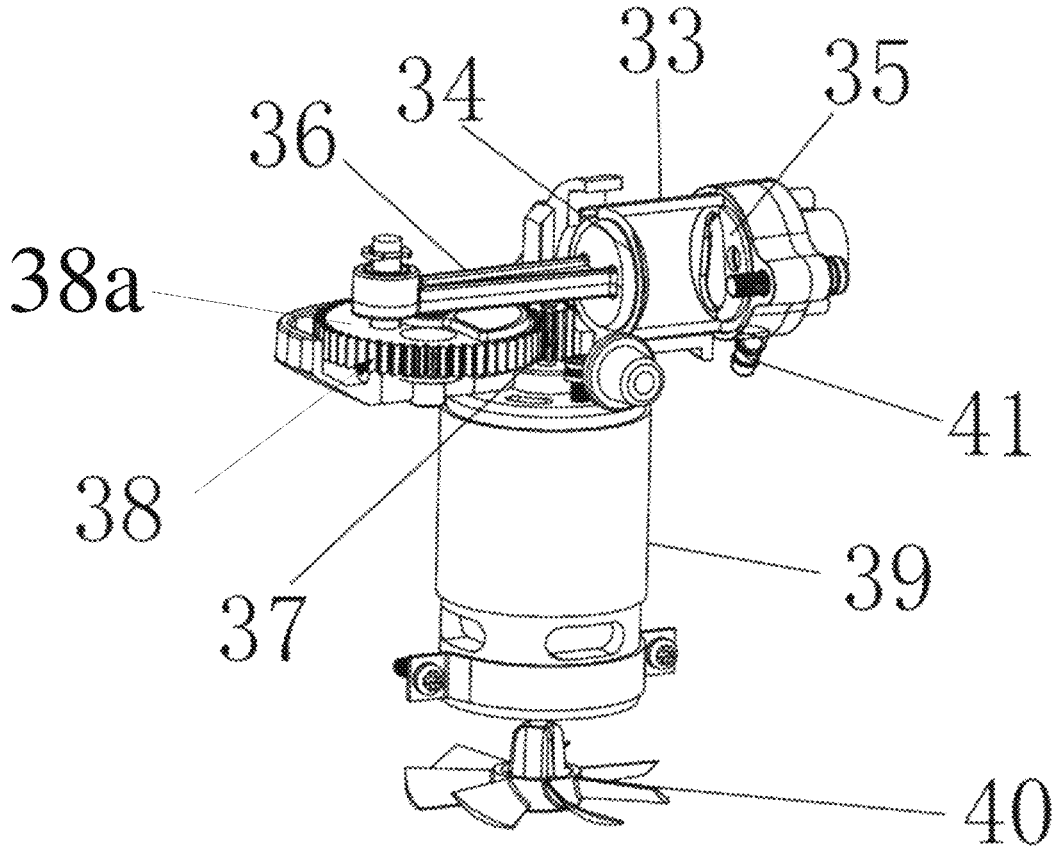
FIG. 6 is a schematic diagram of an internal structure of the second pressure air pump in an embodiment of the present disclosure.
Figure 7:
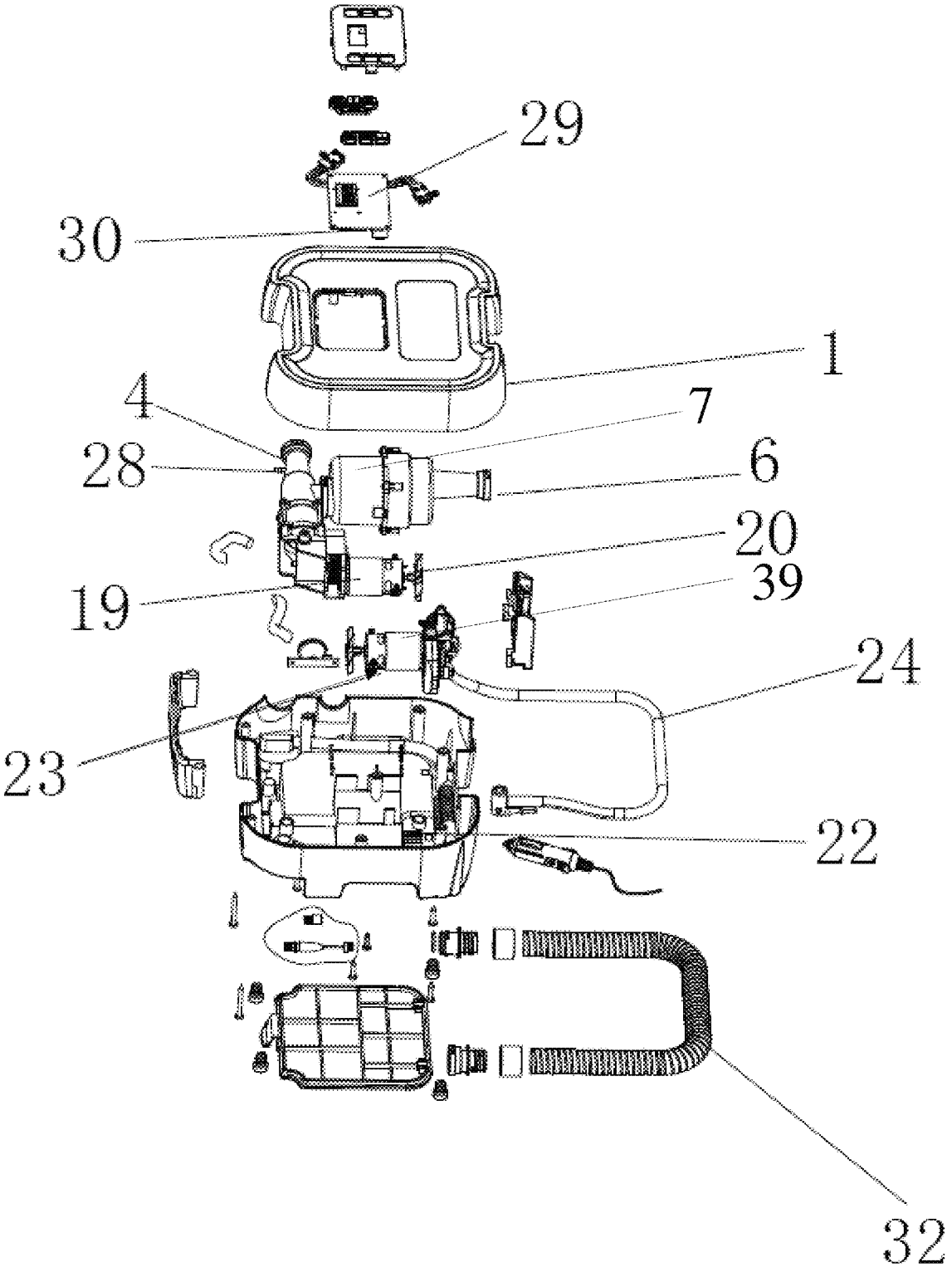
FIG. 7 is an exploded schematic diagram of a structure of a multipurpose inflation pump in an embodiment of the present disclosure.
Figure 8:
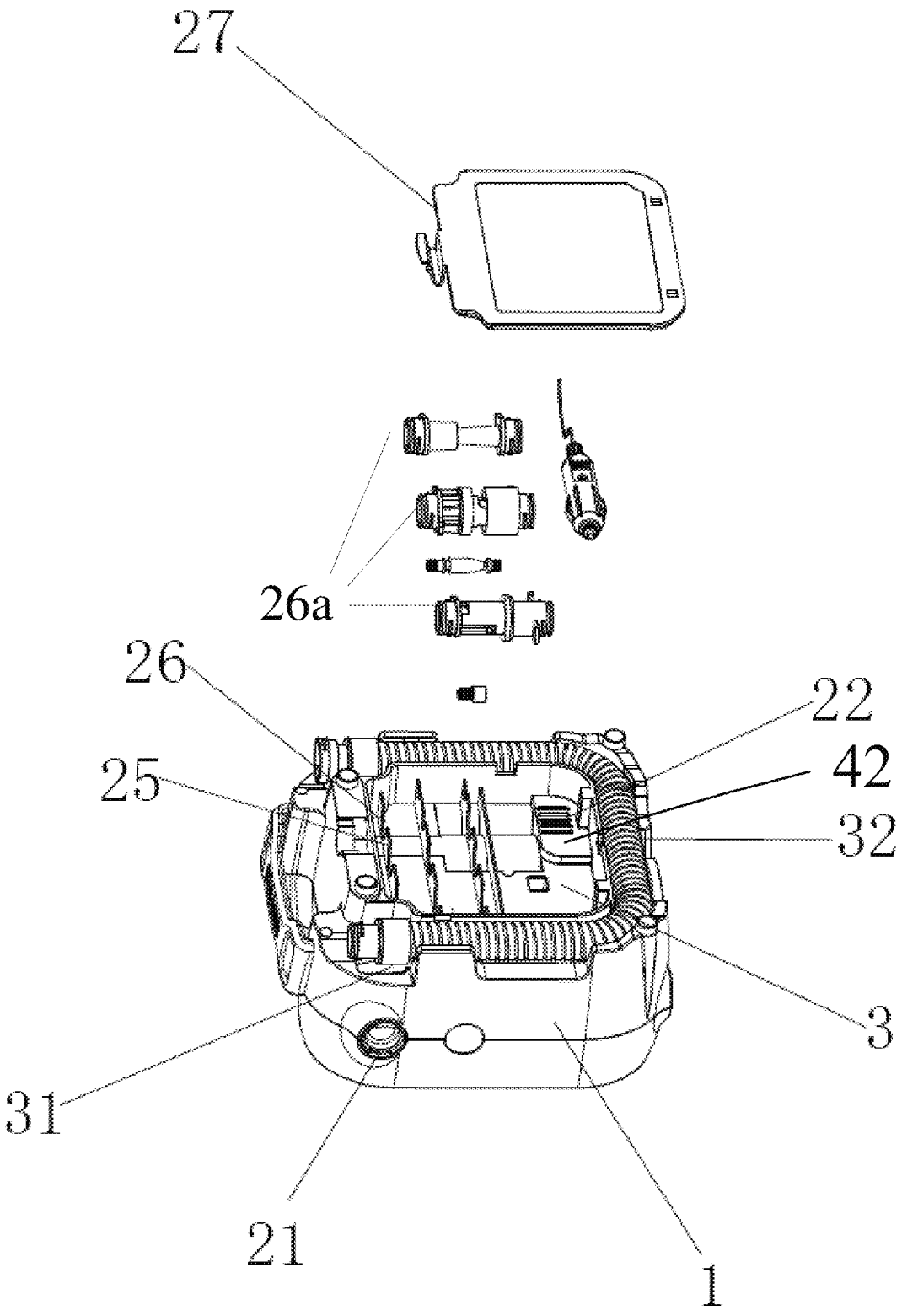
FIG. 8 is an exploded schematic diagram of a structure of a storage cavity in an embodiment of the present disclosure.

In a first embodiment, referring to FIG. 1 to FIG. 8, a multipurpose inflation pump includes a housing 1. The housing 1 is provided with a device cavity 2 and a storage cavity 3, the device cavity 2 and the storage cavity 3 are separated from each other, and a partition plate 42 between the device cavity 2 and the storage cavity 3 is provided with a plurality of cooling holes 22. The device cavity 2 is provided with a first inflation unit and a second inflation unit, and an inflation pressure of the first inflation unit is lower than an inflation pressure of the second inflation unit. The housing 1 may be further provided with a controller 29, the controller 29 may include a circuit board 30, and both of the first inflation unit and the second inflation unit may be controlled by the controller. The first inflation unit may include an inflation conduit 4, the inflation conduit 4 may be further provided with a mounting hole 28 for a pressure sensor, the mounting hole 28 may be proximal to an outlet of the inflation conduit 4, and a first pressure sensor may be disposed in the mounting hole 28 for the pressure sensor. An inlet of the inflation conduit 4 may be connected to a first pressure air pump 5 and a blower 6. An outlet of the first pressure air pump 5 and an outlet of the blower 6 may be sealed to and connected to the inlet of the inflation conduit 4, respectively. The housing 1 may be further provided with access holes 21 configured to allow both an outlet of the inflation conduit 4 and an inlet of the blower 6 to extend out of the housing 1. An outer surface of the housing 1 may be provided with a storage groove 31 which is internal concave, and the storage groove 31 is configured to place an extended pipe 32 connected to the outlet of the inflation conduit 4. The blower 6 may include a shell 7, and a first motor 8 may be disposed in the shell 7. An output shaft of the first motor 8 may be fixedly connected to an air blade 9, and a first one-way outlet valve 10 may be disposed in the shell 7 proximal to the outlet of the blower 6 and configured to flow out one-way air towards the inflation conduit 4. The first pressure air pump 5 may include a first piston cylinder 11, an outlet of which is provided with a second one-way outlet valve 12. The second one-way outlet valve 12 may be configured to flow out one-way air towards the inflation conduit 4. A first piston 13 may be disposed in the first piston cylinder 11 and cooperated with the second one-way outlet valve 12. The first piston 13 may be provided with a first one-way inlet valve 14. An end of the first piston 13 away from the second one-way outlet valve 12 may be fixedly connected to a first connecting rod 15. The first connecting rod 15 may be rotatably connected to an eccentric wheel 16, which is driven by a first large gear 18. The first large gear 18 may be engaged with a first pinion gear 17 which is connected to an output shaft of a second motor 19. An end of the second motor 19 may be provided with a first cooling fan 20. The second inflation unit may include a second pressure air pump 23, and the second pressure air pump 23 may include a third motor 39. An output shaft of the third motor 39 may be connected to a second pinion gear 37, and an end of the third motor 39 may be provided with a second cooling fan 40. The second pinion gear 37 may be engaged with a second large gear 38. A gear plate 38*a* of the second large gear 38 may be rotatably connected to a second connecting rod 36. A connecting portion between the second connecting rod 36 and the second large gear 38 may be proximal to an outer side of the gear plate of the second large gear 38. The second pressure air pump 23 may further include a second piston cylinder 33, and a second piston 34 may be disposed in the second piston cylinder 33. The second piston 34 may be fixedly connected to an end of the second connecting rod 36 away from the second large gear 38. A surface of the second piston 34 away from the second connecting rod 36 may be provided with a second one-way inlet valve 35 arranged in the second piston cylinder 33. The second piston cylinder 33 may be provided with an outlet nozzle 41, the outlet nozzle 41 may be disposed on a sidewall of the second piston cylinder 33 and in communication with the second piston cylinder 33, and the outlet nozzle 41 may be located between the second one-way inlet valve 35 and the second piston 34 and proximal to the second one-way inlet valve 35. The outlet nozzle 41 of the second pressure air pump 23 may be further connected to an air pipe 24 which penetrates through the device cavity 2 and into the storage cavity 3. A plurality of sheets 25 may be disposed in the storage cavity 3, and the plurality of sheets 25 may be further provided with mounting grooves 26 with different sizes. Rapid conversion joints 26*a* may be placed in the mounting grooves 26, and the housing 1 may be further provided with a cover 27 to enter into the storage cavity 3. A second pressure sensor may be disposed in the outlet nozzle 41 of the second pressure air pump 23. All of motors and pressure sensors of the first inflation unit and the second inflation unit may be electrically connected to the circuit board 30.

The first inflation unit and the second inflation unit in the present disclosure may operate independently from each other. When an inflatable bed or an inflatable boat needs to be inflated, a target inflation pressure needed may be set in the controller 29, and a pressure value may not exceed 20 PSI (Pounds per square inch). When the outlet of the inflation conduit 4 is put to an inlet the inflatable bed or the inflatable boat, the multipurpose inflation pump may start to operate. At beginning, the blower 6 of the first inflation unit may operate and the first pressure air pump 5 may not operate, so as to rapidly inflate the inflatable bed or the inflatable boat. After a certain period of time, an airflow blown from the blower 6 may be subject to a pressure of air inside the inflatable bed or the inflatable boat, and it is increasingly difficult to inflate air into the inflatable bed or the inflatable boat. At this moment, the blower 6 may stop operation, the first pressure air pump 5 may be switched to operate, until a pressure detected by the first pressure sensor in the mounting hole 28 for the pressure sensor of the inflation conduit 4 is equal to the set pressure value in the controller 29, the first inflation unit may automatically stop operation, and the inflation may be over. In the present disclosure, a switching time between the blower 6 and the first pressure air pump 5 may be controlled by the controller 29. When the inflatable bed or the inflatable boat needs to be deflated, the set inflation pressure in the controller 29 may be set to zero. At this moment, only the blower 6 may operate, the inlet of the blower 6 may be put to an outlet of the inflatable bed or the inflatable boat, and the blower 6 may rapidly deflate the inflatable bed or the inflatable boat, which will be much faster than natural deflation. When an automobile tire needs to be inflated, a higher inflation pressure may be needed. When the set pressure value in the controller 29 exceeds 20 PSI, the second inflation unit may operate and the first inflation unit may not operate. The second inflation unit may detect a pressure value at the outlet nozzle 41 of the second pressure air pump 23. The second inflation unit may automatically stop operation after the pressure value reaches the set pressure value set by the controller 29.

The specific embodiments described in the present disclosure are merely illustrative of the spirit of the present disclosure. One skilled in the art of the present disclosure may make a variety of modifications or additions to the specific embodiments described or adopt similar alternatives, but not deviate from the spirit of the present disclosure or exceed the scope defined in the appended claims.

What is claimed is:

1. A multipurpose inflation pump, comprising a housing, wherein the housing is provided with a device cavity and a storage cavity which is configured to place an accessory, the device cavity is provided with a first inflation unit and a second inflation unit, the first inflation unit comprises an inflation conduit, an inlet of the inflation conduit is connected to a first pressure air pump and a blower, and an outlet of the first pressure air pump and an outlet of the blower are sealed to and connected to the inlet of the inflation conduit, respectively;

the blower comprises a shell, a first motor is fixedly disposed in the shell, an output shaft of the first motor is fixedly connected to an air blade, and a first one-way outlet valve is disposed in the shell proximal to the outlet of the blower and configured to flow out one-way air towards the inflation conduit; and the first pressure air pump comprises a first piston cylinder, an outlet of which is provided with a second one-way outlet valve, the second one-way outlet valve is configured to flow out one-way air towards the inflation conduit, a first piston is disposed in the first piston cylinder and cooperated with the second one-way outlet valve, the first piston is provided with a first one-way inlet valve, an end of the first piston away from the second one-way outlet valve is fixedly connected to a first connecting rod, the first connecting rod is rotatably connected to an eccentric wheel, which is driven by a first large gear engaged with a first pinion gear, the first pinion gear is connected to an output shaft of a second motor, and an end of the second motor is provided with a first cooling fan;

the second inflation unit comprises a second pressure air pump, the second pressure air pump comprises a third motor, an output shaft of the third motor is connected to a second pinion gear, an end of the third motor is provided with a second cooling fan, the second pinion gear is engaged with a second large gear, a gear plate of the second large gear is rotatably connected to a second connecting rod, and a connecting portion between the second connecting rod and the second large gear is proximal to an outer side of the gear plate of the second large gear;

the second pressure air pump further comprises a second piston cylinder, a second piston is disposed in the second piston cylinder, the second piston is fixedly connected to an end of the second connecting rod away from the second large gear, a second one-way inlet valve is arranged in the second piston cylinder and opposite to the second piston, an outlet nozzle is disposed on a sidewall of the second piston cylinder and in communication with the second piston cylinder, and the outlet nozzle is located proximal to the second one-way inlet valve;

the outlet nozzle of the second pressure air pump is further connected to an air pipe which penetrates through the device cavity and into the storage cavity;

the housing is further provided with a controller, the controller is configured to control the first inflation unit and the second inflation unit to operate independently from each other, the first inflation unit is capable of inflating or deflating, the second inflation unit is capable of inflating, and an inflation pressure of the first inflation unit is lower than an inflation pressure of the second inflation unit;

the first motor, the second motor and the third motor are separated from each other.

2. The multipurpose inflation pump of claim 1, wherein the housing is further provided with two access holes configured to allow both an outlet of the inflation conduit and an inlet of the blower to extend out of the housing.

3. The multipurpose inflation pump of claim 1, wherein the device cavity and the storage cavity are separated from each other, and a partition plate between the device cavity and the storage cavity is provided with a plurality of cooling holes.

4. The multipurpose inflation pump of claim 1, wherein a plurality of sheets are disposed in the storage cavity, the plurality of sheets are further provided with mounting grooves with different sizes, the mounting grooves are configured for allowing rapid conversion joints to be placed, and the housing is further provided with a cover to enter into the storage cavity.

5. The multipurpose inflation pump of claim 1, wherein the inflation conduit is further provided with a mounting hole proximal to an outlet thereof, a first pressure sensor is disposed in the mounting hole, and a second pressure sensor is disposed in an outlet nozzle of the second pressure air pump.

6. The multipurpose inflation pump of claim 5, wherein the controller comprises a circuit board, and the first motor, the second motor, the third motor, the first pressure sensor, and the second pressure sensor are electrically connected to the circuit board.

7. The multipurpose inflation pump of claim 1, wherein an outer surface of the housing is provided with a storage groove which is internal concave, and the storage groove is configured to place an extended pipe.

* * * * *